US005642894A

United States Patent [19]

Sanabria

[11] Patent Number: 5,642,894

[45] Date of Patent: Jul. 1, 1997

[54] KIT FOR ADDING WHEELS TO AN IN-LINE ROLLER SKATE

[76] Inventor: Gaspar Sanabria, 3131 N. Mason Rd., Katy, Tex. 77449-3854

[21] Appl. No.: 620,365

[22] Filed: Mar. 22, 1996

[51] Int. Cl.[6] ..... A63C 17/06

[52] U.S. Cl. ..... 280/11.27; 280/11.22

[58] Field of Search ..... 280/11.19, 11.22, 280/11.23, 11.27, 11.28, 87.042, 11.26, 7.13, 11.2, 767

[56] References Cited

U.S. PATENT DOCUMENTS

| | | | |
|---|---|---|---|
| 480,610 | 8/1892 | Nielson | 280/7.13 |
| 2,048,916 | 7/1936 | Bentzlin | 208/173 |
| 3,387,852 | 6/1968 | Sarro | 280/11.2 |
| 4,711,458 | 12/1987 | Shim | 280/11.22 |
| 5,090,716 | 2/1992 | Borden | 280/87.042 |
| 5,193,827 | 3/1993 | Olson | 280/7.13 |
| 5,271,633 | 12/1993 | Hill, Jr. | 280/11.22 |
| 5,385,356 | 1/1995 | Conte | 280/11.22 |
| 5,398,949 | 3/1995 | Tarng | 280/11.22 |
| 5,421,596 | 6/1995 | Lee | 280/11.19 |
| 5,513,861 | 5/1996 | Monroe et al. | 280/11.22 |
| 5,513,863 | 5/1996 | Klamer et al. | 280/11.27 |
| 5,560,625 | 10/1996 | Kuykendall | 280/11.22 |

*Primary Examiner*—Brian L. Johnson
*Assistant Examiner*—Bridget Avery
*Attorney, Agent, or Firm*—Joseph N. Breaux

[57] ABSTRACT

A kit for adding additional wheels to an in-line roller skate including a front wheel connecting assembly having a front support channel member having a first wheel rotatably secured at a front wheel end thereof and first and second mating formations adapted to mate with the front end of a wheel support channel member of an existing in-line roller skate; a rear wheel connecting assembly having a rear support channel member having a second wheel rotatably secured at a rear wheel end thereof and third and fourth mating formations adapted to mate with the rear end of a wheel support channel member of an existing in-line roller skate; and first and second securing bolt assemblies for securing the front and rear wheel connecting assemblies to the existing roller skate.

4 Claims, 2 Drawing Sheets

KIT FOR ADDING WHEELS TO AN IN-LINE ROLLER SKATE

TECHNICAL FIELD

The present invention relates to conversion kits for in-line roller skates and more particularly to a kit for adding additional wheels to an in-line roller skate that includes a front wheel connecting assembly and a rear wheel connecting assembly.

BACKGROUND ART

In-line skating has become a popular pastime for thousands of people. The skates are available in a variety of configurations and generally include four to six wheels on each skate. In general, the more wheels provided on an in-line skate the better the in-line skate performs. Although a greater number of wheels provides increased performance, in-line skates with more wheels typically are more expensive than comparable in-line skates with less wheels. It would be a benefit, therefore, to have a kit that allowed a user to add additional wheels to a pair of in-line skates. It would be a further benefit if attachment of the additional wheels could be made using existing structural features on an existing in-line skate as a portion of the attachment mechanism.

GENERAL SUMMARY DISCUSSION OF INVENTION

It is thus an object of the invention to provide a kit for adding wheels to an in-line roller skate.

It is a further object of the invention to provide a kit for adding wheels to an in-line roller skate that utilizes existing structural features on an existing in-line skate as a portion of the attachment mechanism for attaching additional wheels.

Accordingly, a kit for adding additional wheels to an in-line roller skate is provided. The kit includes a front wheel connecting assembly having a front support channel member having a first wheel rotatably secured at a front wheel end thereof and first and second mating formations formed within a front skate channel receiving passageway provided at a front skate mating end thereof, the front skate channel receiving passageway being defined on two sides thereof by opposed first and second passageway sidewalls, the first mating formation including a first formation portion of the first passageway sidewall that is defined by a first mating formation wall that extends from the first passageway sidewall and that is contoured to correspond to the profile of a front end side edge of a wheel support channel member of an existing in-line roller skate, the first formation portion of the first passageway sidewall having a first securing bolt receiving aperture formed therethrough, the second mating formation including a second formation portion of the second passageway sidewall that is defined by a second mating formation wall that extends from the second passageway sidewall and that is contoured to correspond to the profile of a front end side edge of a wheel support channel member of an existing in-line roller skate, the second formation portion of the second passageway sidewall having a second securing bolt receiving aperture formed therethrough that is concentrically aligned with the first securing bolt receiving aperture; a rear wheel connecting assembly having a rear support channel member having a second wheel rotatably secured at a rear wheel end thereof and third and fourth mating formations formed within a rear skate channel receiving passageway provided at a rear skate mating end thereof, the rear skate channel receiving passageway being defined on two sides thereof by opposed third and fourth passageway sidewalls, the third mating formation including a third formation portion of the third passageway sidewall that is defined by a third mating formation wall that extends from the third passageway sidewall and that is contoured to correspond to the profile of a rear end side edge of a wheel support channel member of an existing in-line roller skate, the third formation portion of the third passageway sidewall having a third securing bolt receiving aperture formed therethrough, the fourth mating formation including a fourth formation portion of the fourth passageway sidewall that is defined by a fourth mating formation wall that extends from the fourth passageway sidewall and that is contoured to correspond to the profile of a rear end side edge of a wheel support channel member of an existing in-line roller skate, the fourth formation portion of the fourth passageway sidewall having a fourth securing bolt receiving aperture formed therethrough that is concentrically aligned with the third securing bolt receiving aperture; a first securing assembly having a portion thereof adapted to pass through the first and second securing bolt receiving apertures; and a second securing assembly having a portion thereof adapted to pass through the third and fourth securing bolt receiving apertures.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
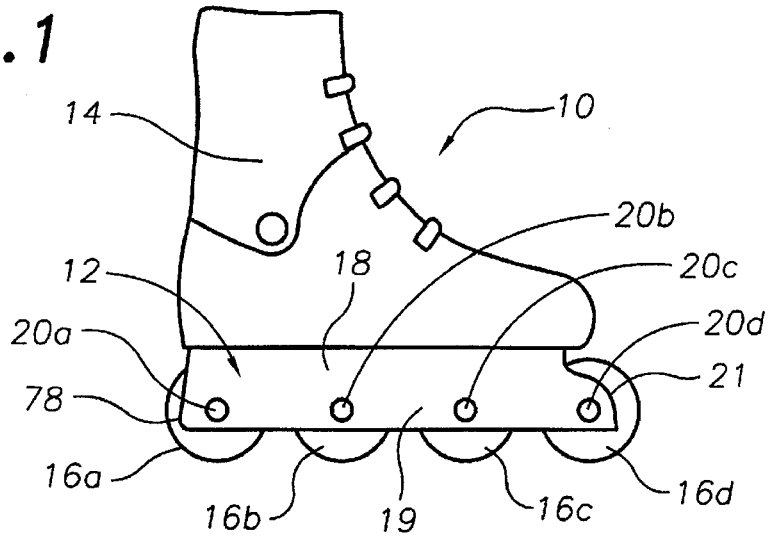
FIG. 1 is a side view of a representative in-line roller skate of the type for which the wheel adding kit of the present invention is used.

FIG. 1 is a side view of a representative in-line roller skate generally designated by the numeral 10. Roller skate 10 includes a roller portion, generally designated by the numeral 12, that is secured beneath a shoe portion 14. Roller portion 12 includes four wheels 16*a–d* that are rotatably secured to a wheel support channel member 18. Wheel support channel 18 has two parallel side members 19 (only one shown) that each have four bolt apertures formed therethrough and that are spaced apart a distance to allow wheels 16*a–d* to be placed therebetween. Each wheel 16*a–d* is rotatably secured between parallel side members 19 with a removable bolt assembly 20*a–d*, respectively.

Figure 2:
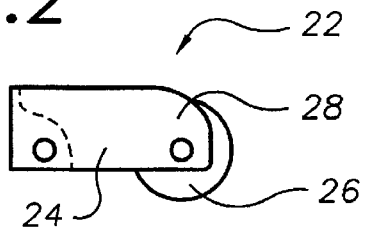
FIG. 2 is a side view of an exemplary front wheel connecting assembly securable to the front of the representative roller skate.
Figure 3:
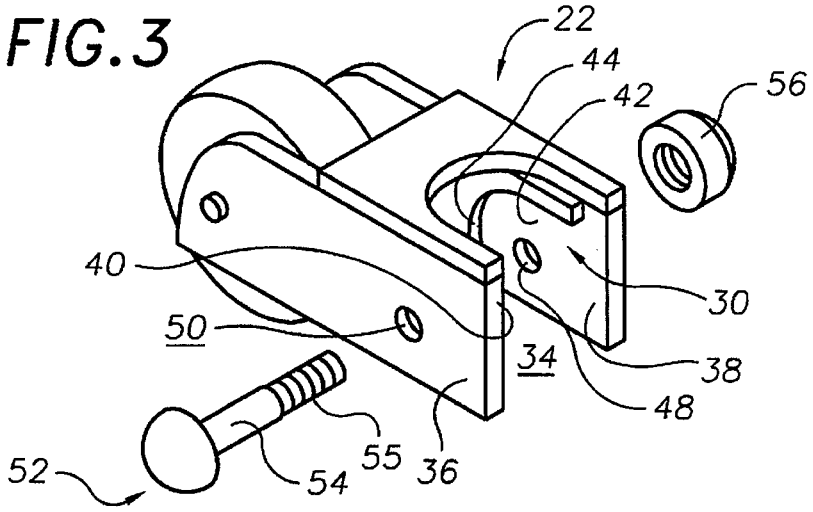
FIG. 3 is a perspective view of the exemplary front wheel connecting assembly of FIG. 2 showing one of the two front mating formations within the front skate mating end.

FIG. 2 shows an exemplary front wheel connecting assembly of the kit of the present invention, generally designated by the numeral 22. Front wheel connecting assembly 22 includes a front support channel member 24 having a first wheel 26 rotatably secured at a front wheel end 28 thereof. With reference to FIG. 3, first and second mating formations, generally designated by the numerals 30,32 (second mating formation 32 shown in FIG. 4) are formed within a front skate channel receiving passageway 34 provided at a front skate mating end 36 of front wheel connecting assembly 22. Skate channel receiving passageway 34 is sufficiently wide to receiving therein a front edge portion 21 of wheel support channel 18 (FIG. 1).

Front skate channel receiving passageway 34 is defined on two sides by opposed, planar first and second passageway sidewalls 38,40. In this embodiment, first mating formation 30 is a mirror image of second mating formation 32. The configuration of first mating formation 30 is, therefore, also applicable to second mating formation 32. Each mating formation 30,32 includes a formation portion 42 of the planar passageway sidewall 38,40, of which it is a part, that is defined by a mating formation wall 44 that extends from the planar passageway sidewall 38,40 and that is contoured to correspond to the profile of a front end side edge 46 (FIG. 1) of wheel support channel member 18.

Figure 4:
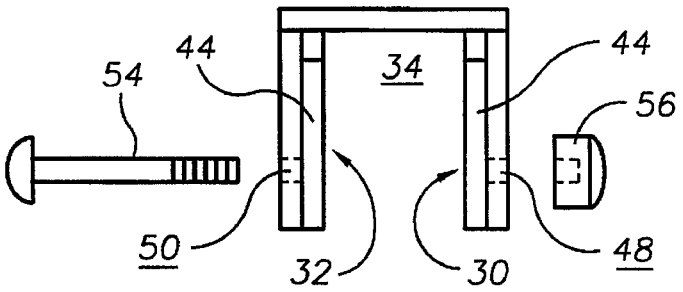
FIG. 4 is a plan view of the front skate mating end of the exemplary front wheel connecting assembly with the wheel removed showing the first and second raised formation walls extending into the front skate channel receiving passageway forming the first and second front mating formations and the front wheel connecting assembly securing assembly.

A first securing bolt receiving aperture 48 is formed through first planar passageway sidewall 38. A second securing bolt receiving aperture 50 is formed through second planar sidewall 40 that is concentrically aligned with first securing bolt receiving aperture 48. Also shown in the figure is a first securing assembly, generally designated by the numeral 52, including a first bolt member 54, having a threaded end 55, and a first nut member 56. With reference to FIG. 4, first bolt member 54 is of a length sufficient to be placed through first and second securing bolt apertures 48,50 and first nut member 56 threaded onto threaded end 55.

Figure 5:
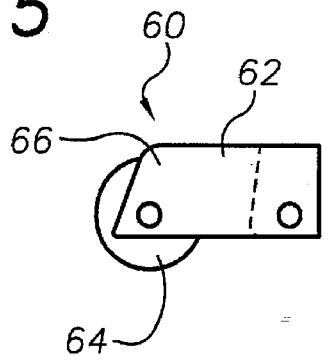
FIG. 5 is a side view of an exemplary rear wheel connecting assembly securable to the rear of the representative roller skate.
Figure 6:
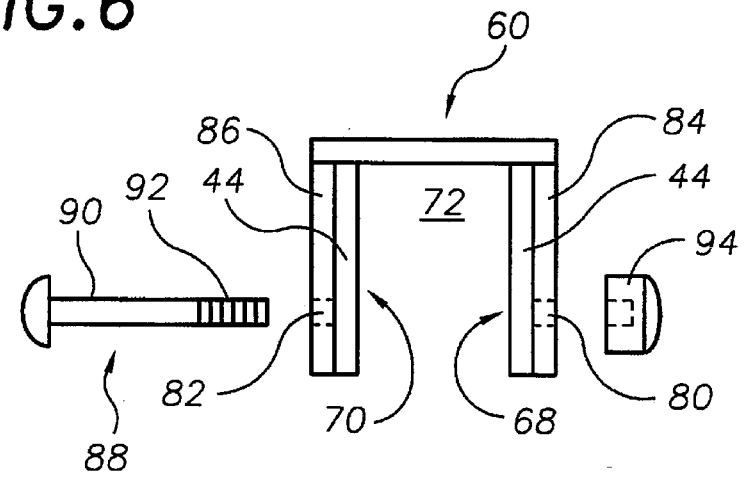
FIG. 6 is a plan view of the rear skate mating end of the exemplary rear wheel connecting assembly with the wheel removed showing the first and second raised formation walls extending into the rear skate channel receiving passageway forming the first and second rear mating formations and the rear wheel connecting assembly securing assembly.

A rear wheel connecting assembly is shown in FIG. 5 generally designated by the numeral 60. Rear wheel connecting assembly 60 includes a rear support channel member 62 having a second wheel 64 rotatably secured at a rear wheel end 66. With reference to FIG. 6, rear wheel connecting assembly 60 also includes third and fourth mating formations 68,70 formed within a rear skate channel receiving passageway 72 provided at a rear skate mating end 74 thereof (FIG. 5). The construction of third and fourth mating formations 68,73 is identical to the construction of first and second mating formations with the exception that third and fourth mating formation walls 74 are contoured to correspond to the profile of a rear end side edge 78 (FIG. 1) of wheel support channel member 18. Third and fourth concentrically aligned securing bolt receiving apertures 80,82 are formed through opposed, planar third and fourth sidewalls 84,86, respectively. Also shown in the figure is a second securing assembly, generally designated by the numeral 88, including a second bolt member 90, having a threaded end 92, and a second nut member 94. Second bolt member 90 is of a length sufficient to be placed through third and fourth securing bolt apertures 80.82 and second nut member 94 threaded onto threaded end 92.

Figure 7:
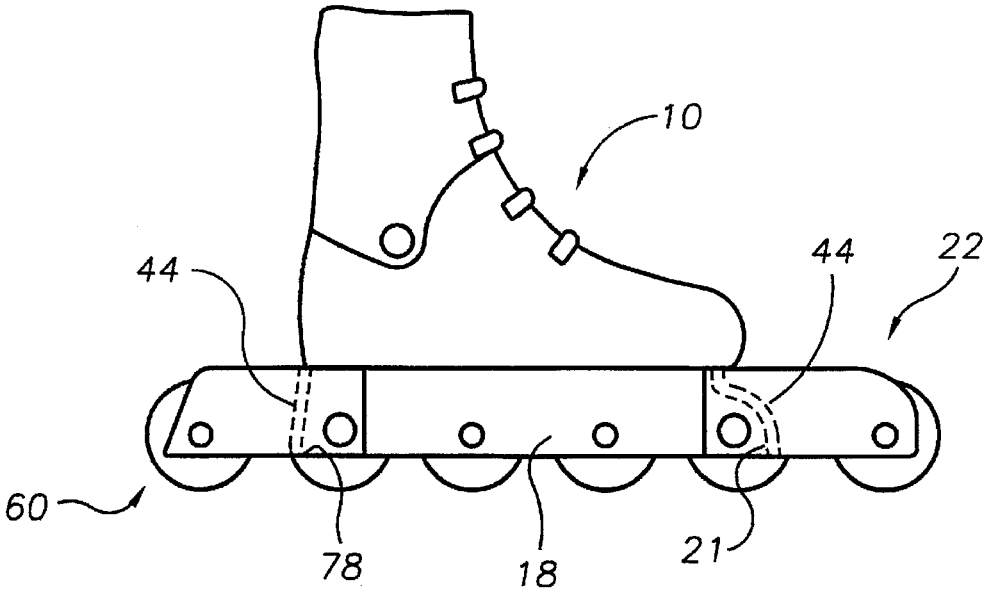
FIG. 7 is a side view of the representative roller skate of FIG. 1 with the exemplary front wheel connecting assembly of FIG. 2 secured to the front thereof and the exemplary rear wheel connecting assembly of FIG. 5 secured to the rear thereof.

FIG. 7 shows the exemplary front wheel connecting assembly 22 and the exemplary rear wheel connecting assembly 60 secured to wheel support channel member 18 of representative in-line skate 10. Use of the exemplary kit is new described with general reference to FIG. 1–7. Front wheel connecting assembly 22 is attached to wheel support channel 18 as follows. The existing bolt assembly 20*d* is removed and front edge portion 21 of wheel support channel 18 inserted into front channel receiving passageway 34 until front edge portion 21 contacts mating formation wall 44. With edge portion 21 in this position, first and second securing bolt receiving apertures 48,50 are in alignment with the bolt apertures of wheel 22*d*. First bolt member 54 is then inserted through first bolt receiving aperture 48, a bolt aperture of wheel 22*d*, wheel 22*d*, a second bolt aperture of wheel 22*d*, and second bolt receiving aperture 50. First nut 56 is then threaded onto threaded end 55 and tightened.

Rear wheel connecting assembly 60 is attached to wheel support channel 18 as follows. The existing bolt assembly 20*a* is removed and rear edge portion 78 of wheel support channel 18 inserted into rear channel receiving passageway 72 until rear edge portion 78 contacts mating formation walls 44 of third and fourth mating formations 68,70. With rear edge portion 78 in this position, third and fourth securing bolt receiving apertures 80,82 are in alignment with the bolt apertures of wheel 22*a*. Second bolt member 90 is then inserted through third bolt receiving aperture 80, a bolt aperture of wheel 22*a*, wheel 22*a*, a second bolt aperture of wheel 22*a*, and fourth bolt receiving aperture 82. Second nut member 94 is then threaded onto threaded end 92 and tightened.

It can be seen from the preceding description that a kit for adding wheels to an in-line roller skate has been provided that utilizes existing structural features on an existing in-line skate as a portion of the attachment mechanism for attaching additional wheels.

It is noted that the embodiment of the kit for adding wheels to an in-line roller skate described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A kit for adding wheels to an in-line roller skate having a wheel support channel member, said kit comprising:

a front wheel connecting assembly having a front support channel member having a first wheel rotatably secured at a front wheel end thereof and first and second mating formations formed within a front skate channel receiving passageway provided at a front skate mating end thereof, said front skate channel receiving passageway being defined on two sides thereof by opposed first and second passageway sidewalls, said first mating formation including a first formation portion of said first passageway sidewall that is defined by a first mating formation wall that extends from said first passageway sidewall and that is contoured to correspond to a profile of a front end side edge of said wheel support channel member of an existing in-line roller skate, said first formation portion of said first passageway sidewall having a first securing bolt receiving aperture formed therethrough, said second mating formation including a second formation portion of said second passageway sidewall that is defined by a second mating formation wall that extends from said second passageway sidewall and that is contoured to correspond to a profile of a front end side edge of said wheel support channel member of an existing in-line roller skate, said second formation portion of said second passageway sidewall having a second securing bole receiving aperture formed therethrough that is concentrically aligned with said first securing bolt receiving aperture;

a rear wheel connecting assembly having a rear support channel member having a second wheel rotatably secured at a rear wheel end thereof and third and fourth mating formations formed within a rear skate channel receiving passageway provided at a rear skate mating end thereof, said rear skate channel receiving passageway being defined on two sides thereof DV opposed third and fourth passageway sidewalls, said third mating formation including a third formation portion of said third passageway sidewall that is defined by a third mating formation wall that extends from said third passageway sidewall and that is contoured to correspond to a profile of a rear end side edge of said wheel support channel member of an existing in-line roller skate, said third formation portion of said third passageway sidewall having a third securing bolt receiving aperture formed therethrough, said fourth mating formation including a fourth formation portion of said fourth passageway sidewall that is defined by a fourth mating formation wall that extends from said fourth passageway sidewall and that is contoured to correspond to a profile of a rear end side edge of said wheel support channel member of an existing in-life roller skate, said fourth formation portion of said fourth passageway sidewall having a fourth securing bolt receiving aperture formed therethrough that is concentrically aligned with said third securing bolt receiving aperture;

a first securing assembly having a portion thereof adapted to pass through said first and second securing bolt receiving apertures; and a second securing assembly having a portion thereof adapted to pass through said third and fourth securing bolt receiving apertures.

2. The kit for adding wheels to an in-line roller skate of claim 1, wherein:

said first, second, third, and fourth passageway sidewalls are planar.

3. The kit for adding wheels to an in-line roller skate of claim 1, wherein:

said first securing assembly has a first bolt member and a first nut member adapted for connection with the first bolt member, said first bolt member being adapted to pass through said first and second securing bolt receiving apertures; and said second securing assembly has a second bolt member and a second nut member adapted for connection with said second bolt member, said second bolt member being adapted to pass through said third and fourth securing bolt receiving apertures.

4. The kit for adding wheels to an in-line roller skate of claim 3, wherein:

said first, second, third, and fourth passageway sidewalls are planar.

* * * * *